United States Patent [19]

Baker

[11] 4,308,744

[45] Jan. 5, 1982

[54] TUBE POINTER

[75] Inventor: Ellery L. Baker, Warwick, R.I.

[73] Assignee: United Wire & Supply Corporation, Cranston, R.I.

[21] Appl. No.: 119,850

[22] Filed: Feb. 8, 1980

[51] Int. Cl.[3] ..... B21D 41/04

[52] U.S. Cl. ..... 72/402

[58] Field of Search ..... 72/402, 410, 409, 399, 72/367, 189; 29/237, 517

[56] References Cited

U.S. PATENT DOCUMENTS

| | | | |
|---|---|---|---|
| 2,999,405 | 9/1961 | Ewart | 72/402 |
| 3,073,374 | 1/1963 | Valente | 72/402 |
| 3,154,978 | 11/1964 | Baker | 72/416 |
| 3,245,247 | 4/1966 | Valente | 72/402 |
| 3,292,414 | 12/1966 | Goeke | 72/402 |
| 3,370,451 | 2/1968 | Schuetz | 72/402 |
| 3,417,598 | 12/1968 | Valente | 72/469 |
| 4,043,172 | 6/1977 | Schmittou | 72/409 |

FOREIGN PATENT DOCUMENTS

| | | | |
|---|---|---|---|
| 449558 | 9/1927 | Fed. Rep. of Germany | 72/402 |
| 2709163 | 9/1978 | Fed. Rep. of Germany | 72/402 |
| 8105 | of 1915 | United Kingdom | 72/402 |
| 567355 | 2/1945 | United Kingdom | 72/402 |

*Primary Examiner*—Gene P. Crosby

*Attorney, Agent, or Firm*—Barlow & Barlow

[57] ABSTRACT

A tube pointer for compressing metal tubes prior to drawing the tubes through a die that employs a plurality of pairs of jaws oriented about a central axis. The jaws are provided with recesses and one side wall thereof receives portions of a juxtaposed jaw that allows the jaws to close fully.

5 Claims, 6 Drawing Figures

TUBE POINTER

BACKGROUND OF THE INVENTION

The present invention relates to an apparatus which presses the end of a tube to reduce dimension thereof to form what is called a point or more specifically the invention relates to a novel apparatus for reducing a diameter or pointing a tubular workpiece so that the same may be easily inserted into a die for drawing the tube and reduce its diameter.

In the prior art there is known a number of apparatuses which will reduce the diameter of tubing. Basically, the devices employ jaws which reciprocate radially inward, for example, as seen in my prior U.S. Pat. No. 3,154,978. Other approaches which utilize modified jaws but which operate on a similar principle are seen in the Valente patents U.S. Pat. Nos. 3,245,247 and 3,417,598. Still other forms of jaws are seen in the Schuetz U.S. Pat. No. 3,370,451. In each of these disclosures, a tube is positioned into an opening and jaws collapse the tube to the desired shape. With these and other similar tube pointers, while they are capable of producing usable points, they are subject to jamming. For example, in my prior United States Patent referenced above, the fin surface of the jaw grips the tube and prevents the tube from elongating which causes the pointer to jam. In addition, utilizing a jaw such as I have previously disclosed, there is the possibility of metal chips being generated due to the openings in the jaw surfaces. Also with certain types of jaws it is almost impossible to work on stiffer metals such as brass, for the parts of the jaws will break. Further in many types of prior art devices particularly in devices as seen in the Schuetz patent U.S. Pat. No. 3,370,451, the metal of tube while it is being compressed would tend to extrude into any opening that it can find, and this is well illustrated in FIG. 11 of this particular patent. The result is various point sizes that may not be easily predicted, it being necessary to provide a point with a predictable size so that it can be grasped by the drawing gripper jaws.

SUMMARY OF THE INVENTION

The present invention discloses an improved tube pointer which produces uniform points by preventing any flaring of the tube material, there being no openings in the jaws in which the flaring can occur. Moreover, the jaws used in the instant invention have a solid work engaging surface that eliminates breakage that was previously encountered with finned jaws.

The tube pointer of the instant invention includes a generally circular housing that has at least four but preferably six jaws that are arranged about an end with an opening. These jaws are interfitted to permit them to move radially inward and outward and have work-engaging surfaces which form the tube into a polygonal cross sectional shape. To prevent any openings between the jaws, the jaws have recesses on one side face thereof so that a juxtaposed jaw will slide into the recess. In the illustrative form the jaws which are formed in this fashion will, in effect, reduce the open end of the apparatus to no hole whatsoever, and it will readily become apparent that this will permit, through suitable adjustment of the operating mechanism, the pointing of a variety of sized tubes. Each jaw is coupled to a ram so that it moves through a wedged segment uniformly towards the axis of the tube at the same rate as each other jaw, and thus the tube is always maintained concentric at all stages of the pointing operation.

DESCRIPTION OF THE PREFERRED EMBODIMENT

Figure 1:
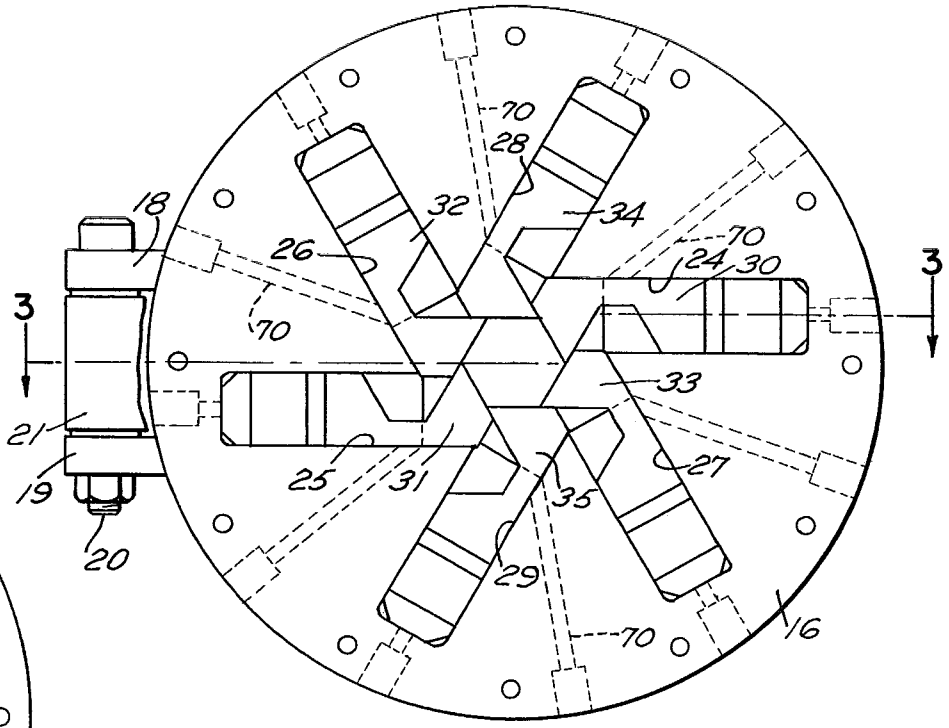
FIG. 1 is a front elevational view showing the jaw assembly with the jaws open and with the cover plate removed.

With reference to the drawings 10 designates a cylindrical housing having flanges 11, which housing serves as a guidance member for a ram plate 12 that is connected to a hydraulic piston (not shown) through a piston rod 14. Reference is made, however, to my prior patent U.S. Pat. No. 3,154,978 for a suitable method of actuating the ram plate. The housing 10 is continued through a cylindrical chuck plate 16 which is bolted to outwardly extending flanges 11 by bolts 17. Ears 18, 19 are projected radially outward from the plate 16 and a pin 20, that extends between the ears, mounts for pivotal relationship a cover plate 22. The cover plate 22 is normally secured to the chuck plate 16 by a plurality of bolts such as 24 but may be readily swung away on the boss 21 of the cover plate 22 to provide access to the interior of the assembly. Also bolted to the cover plate is a wear plate 23, the purpose of which will be presently apparent.

In the present illustration of the device there are six jaw members arranged in opposite pairs, one opposed pair comprising jaws 30, 31, a second opposed pair of jaws 32, 33 and a third pair 34, 35. The cylindrical chuck plate 16 is provided with chordal slots 24, 25, 26, 27, 28 and 29 into which jaws and operating segments are disposed. These pairs of jaws are disposed in the slots 24 to 29 and the slots serve as guideways for the jaw members 30 to 35 which will assist in directing their path of sliding movement in a chordal direction axially inward and outward.

Figure 3:
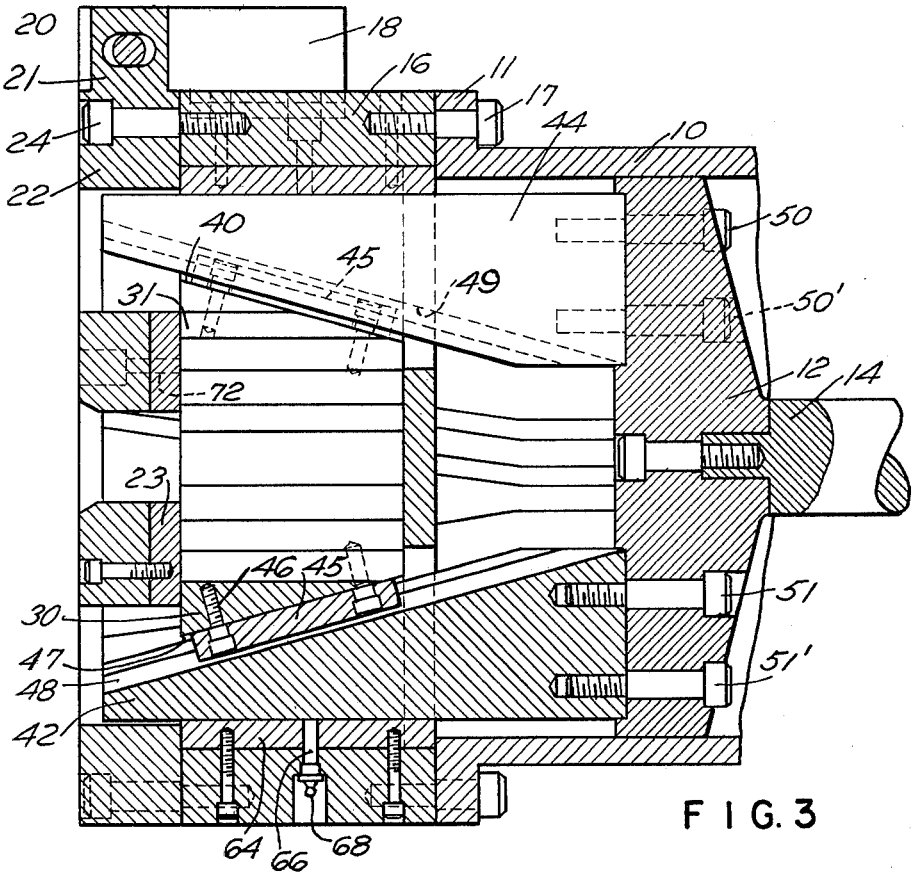
FIG. 3 is a sectional view of the tube pointer assembly made in accordance with this invention taken on lines 3—3 of FIG. 1.
Figure 4:
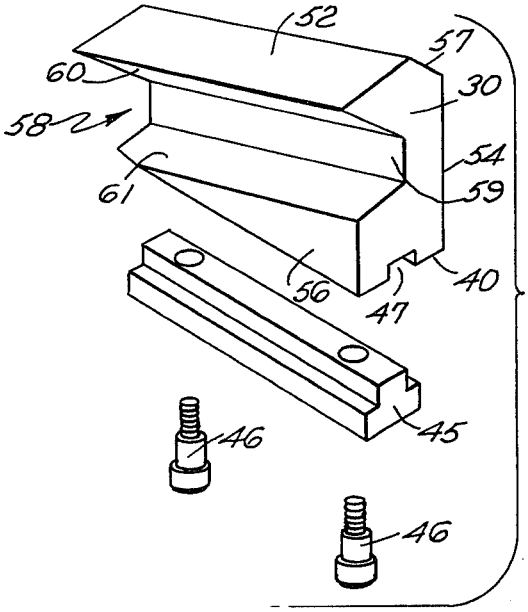
FIG. 4 is an exploded view showing one of the jaws.

As seen in FIG. 3 and FIG. 4, each of the jaw members is provided with an inclined surface 40 and are mounted in sliding engagement with a wedge-shaped segment, such as the segment 42 or 44. The segments are connected to the jaws by means of a suitable key and slot arrangement made up of a T-bar 45 that is bolted as with bolts 46 into a recess 47 in the jaw, the T-bar 45 being received in a mating slot in the segment such as 48 or 49 as seen in FIG. 3. The segments such as 42, 44 are fastened to the ram 12 by bolts such as 50, 50', 51, 51' and may be moved to and fro within the housing 10. As will be apparent when the wedge-shaped segments are moved to the left as seen in FIG. 1 the jaws will slide on the key and slot structure and can simultaneously move radially inward to compress a tube.

Figure 2:
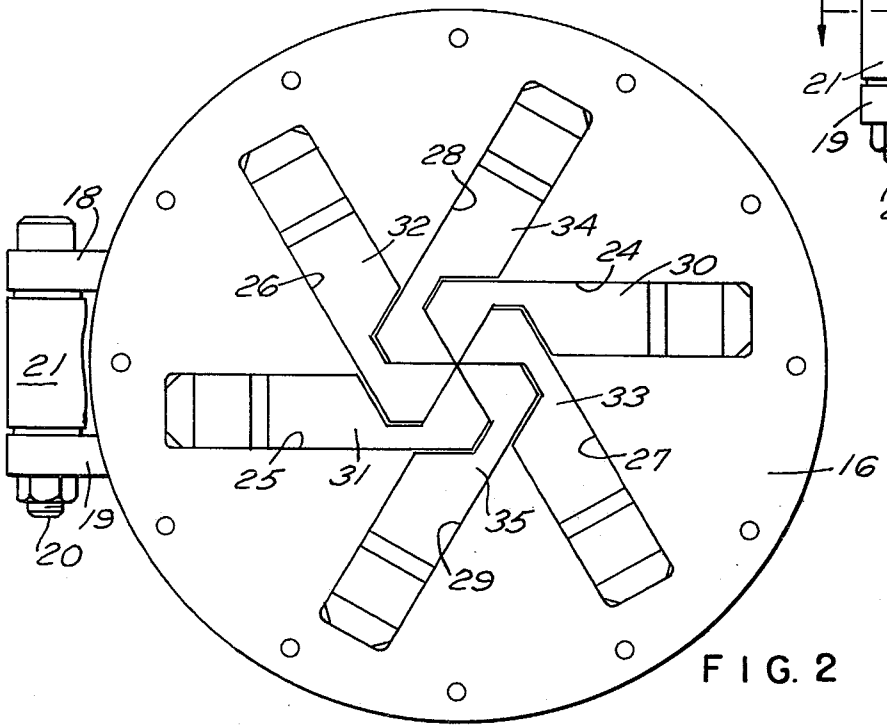
FIG. 2 is a similar view showing the jaws in their fully closed position.

One of the jaws 30, for example, is shown in FIG. 4 and is provided with a work-engaging surface 52, a pair of side faces 54, 56 and a chamfered end face 57. The side face 56 is provided with a recess generally indicated at 58 and this recess is defined by a bottom wall 59 and a pair of entering end walls 60 and 61. Referring to FIG. 1 and FIG. 2, it will be seen that the arrangement is such that a work-engaging surface such as 52 of a juxtaposed jaw will effectively slide on the entering wall 60 of the recess and permit the jaws to completely close as seen in FIG. 2. It will of course be apparent that all of the jaws 30 to 35 are duplicates insofar as the recesses and faces are concerned and as the wedge segments move to and fro within the housing the work-engaging faces of adjacent jaws will enter their recesses. Guidance of the wedge segments such as 42, 44 within the housing are enhanced by slide plates 64 which are preferably grooved and fed by a grease bore 66 that has a pressure grease fitting such as 68 tapped therein. Additionally, as will appear in FIG. 2, in order to enhance sliding movement of the jaws and wedge segments in a radially inward and outward direction grease bores such as 70 are provided. Further the pressure plate 23 which absorbs the axial load is provided with grease ports such as 72.

Figure 5:
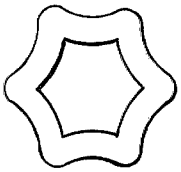
FIGS. 5 and 6 are end views of tubes that have been compressed utilizing the invention, showing the manner in which the tube may be deformed.
Figure 6:
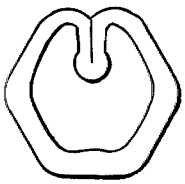

It will of course be apparent that since the jaws are, in effect, in an interengaging relationship by entering recesses provided in juxtaposed jaws, the jaw-engaging surfaces will substantially circumscribe a tube which is to be pointed, and as the jaw members are moved simultaneously radially inward by the wedge-shaped segments, a tube, such as the tube in FIG. 5 or in FIG. 6, will be deformed and may take a variety of shapes depending upon whether or not the wall is uniform. If the wall is uniform, a shape similar to that seen in FIG. 5 will be attained, while if the wall is not uniform as seen in FIG. 6 and has, for example, a thicker wall portion as at W, then this will restrain any deformation in that area and all of the deformation will take place as at X with a portion of the tube being deformed inwardly in order to maintain the proper outward dimensions.

Although there has been shown six jaws to form a hexagonal point shape, other shapes such as octagonal or square can be used. It has been found that the strongest jaws and the most productive shape for tube pointing is found in the preferred hexagonal form.

I claim:

1. A tube pointer comprising a housing having at least an opening in one end, a plurality of pairs of jaw means with opposed work engaging faces, means to simultaneously move the jaw means in said housing in a chordal path, said jaw means comprising a block with parallel side faces, a work-engaging face and a rear face, a longitudinal recess on one side face, said recess having a wall substantially the width and length of the work-engaging face that receives for sliding engagement the work-engaging face of a juxtaposed jaw means whereby the jaw means may completely close the opening at said one end of said housing.

2. A tube pointer as in claim 1 wherein the means to move the jaw means comprises a ram, a plurality of generally radially extending segments fixed to said ram, said segments having oblique radially inward surfaces, said jaw means being slidably supported on said segments.

3. A tube pointer as in claim 1 wherein said jaw means has a chamfered end face contiguous to the work-engaging face.

4. A tube pointer as in claim 2 wherein a chuck plate is provided and the jaw means and the segments are guided in slots in said plate.

5. A tube pointer as in claim 4 wherein the housing has a cover plate over the end with said opening, a central aperture aligning with said opening to receive a tube, said cover plate retaining the jaws within the chuck plate.

* * * * *